United States Patent [19]

Nemoto

[11] 4,290,053

[45] Sep. 15, 1981

[54] SOUND EFFECTS PRODUCER

[76] Inventor: Kuniichi Nemoto, 2357, Jinkaiji-machi, Chofu-shi, Tokyo, Japan

[21] Appl. No.: 919,796

[22] Filed: Jun. 28, 1978

[30] Foreign Application Priority Data

Feb. 22, 1978 [JP] Japan ..... 53/19300

[51] Int. Cl.[3] ..... G08B 3/10

[52] U.S. Cl. ..... 340/384 E; 340/384 E

[58] Field of Search ..... 340/384 E; 331/111, 331/107 R

[56] References Cited

U.S. PATENT DOCUMENTS

| | | | |
|---|---|---|---|
| 3,220,732 | 11/1965 | Pincus | 340/384 E |
| 3,302,128 | 1/1967 | Schoemeidl | 331/107 R |
| 3,509,492 | 4/1970 | Ponc et al. | 331/111 |
| 3,742,379 | 6/1973 | McLean | 331/111 |
| 3,873,937 | 3/1975 | Lindstrum | 331/111 |
| 4,103,258 | 7/1978 | Iida | 331/111 |

*Primary Examiner*—Harold I. Pitts

*Attorney, Agent, or Firm*—Connolly and Hutz

[57] ABSTRACT

Sound effects producer comprises a Zener diode with an inverse voltage impressing circuit connected to the cathode side of the Zener diode for generating a random noise output from the anode of the Zener diode. A speaker system is connected to the anode side of the Zener diode for changing the random output signal to a sound. A control circuit is built into the inverse voltage impressing circuit for controlling the output wave form of that circuit.

2 Claims, 19 Drawing Figures

SOUND EFFECTS PRODUCER

BACKGROUND OF THE INVENTION

The present invention relates to a sound effects producer in which various sound effects are produced from an electric circuit, more specifically to a device in which a noise output from a semiconductor element is amplified to issue from a speaker for sound effects.

There are various sound effects and they are produced in various ways, but conventional methods are mostly mechanical which cannot produce the sound effects with high fidelity. Moreover, according to these methods, the tone cannot be altered by simple operation, and conventional devices lack in universal applicability. Furthermore, because of bulkiness which hinders their being built into a toy, etc., these mechanical devices are found impractical.

SUMMARY OF THE INVENTION

The primary object of the present invention is to provide a device which produces sound effects with high fidelity.

Another object of the present invention is to provide a universally available device which produces sound effects with the tone variable by simple operation.

Still another object of the present invention is to provide a sound effects producer which is easy to miniaturize and which fits into small items such as toys and the like.

In accordance with the present invention, a sound effects producer comprises a semiconductor element with a fundamental wave-generating circuit connected thereto for impressing thereon an inverse voltage higher than the breakdown point. A speaker is connected to the fundamental wave-generating circuit for changing the output signal from that circuit to an audible sound, and a control circuit is built into the fundamental wave-generating circuit for controlling the output wave-form of the fundamental wave-generating circuit.

BRIEF DESCRIPTION OF THE DRAWINGS

Novel features and advantages of the present invention in addition to those mentioned above will become apparent to those skilled in the art from a reading of the following detailed description in conjunction with the accompanying drawings wherein.

DETAILED DESCRIPTION OF THE INVENTION

Figure 1:
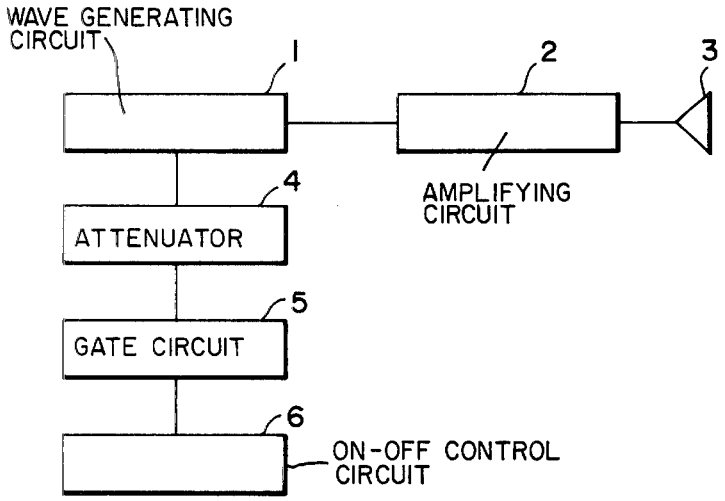
FIG. 1 is a block diagram showing the basic construction of a device according to the present invention.

In FIG. 1, 1 denotes a fundamental wave-generating circuit which impresses an inverse voltage higher than the breakdown point of the semiconductor element. A speaker 3, i.e., a sound producer, is connected via the amplifying circuit 2 to the output side of the fundamental wave-generating circuit 1. To the circuit 1 is connected an attenuator 4 which constitutes a part of the control circuit for changing the output waveform of the said circuit 1. The attenuator 4 controls the action of the circuit 1, thereby attenuating the output signal therefrom. To the attenuator 4 is connected via the gate circuit 5 an on-off control circuit 6 which constitutes a part of the control circuit. The circuit 6 controls the attenuator 4.

The fundamental wave-generating circuit 1 utilizes the breakdown voltage characteristic of a semiconductor element. As the semiconductor element, an ordinary diode or transistor may be used at a place between a base and an emitter thereof, but the best performance will be obtained with use of a Zener diode.

Figure 2:
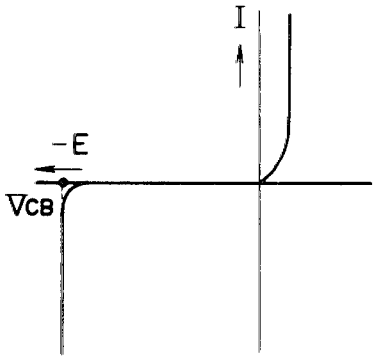
FIG. 2 is a schematic current-voltage diagram illustrating the forward-reverse direction characteristic of a Zener diode to be used in the fundamental wave-generating circuit of FIG. 1.
Figure 3:
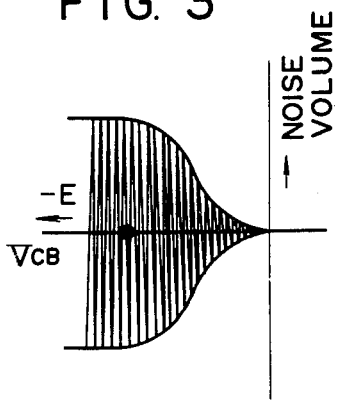
FIG. 3 is a schematic diagram of the noise output wave-form of the Zener diode shown in FIG. 2.

FIG. 2 illustrates the forward-reverse direction characteristic of a Zener diode, while FIG. 3 shows the noise output of a Zener diode, the symbol $V_{CB}$ in these figures denoting the breakdown point of an impressed inverse voltage. As indicated in FIG. 3, the noise output of the Zener diode obtains constant noise output voltage under impression of an inverse voltage higher than the saturation point, i.e., the breakdown point $V_{CB}$; this is attributable to the forward-reverse direction voltage characteristic of the Zener diode (see FIG. 2). Namely, past the saturation point a change in the impressed voltage barely affects the noise voltage. This is a difference from the case of using the base-emitter element of an ordinary diode or transistor.

As the power source to apply an inverse voltage to the Zener diode, a dry cell is employed when the effect of a rifle or pistol shot is to be produced. Under use of a dry cell as the power source, when the trigger of a toy rifle or piston is pulled to turn the on-off switch of the control circuit 6 on, thereby impressing an inverse voltage on the Zener diode and causing the noise output of the Zener diode to issue a large sound from the speaker 3, the load current (consumed current) of the whole circuit becomes large and at this instant the source voltage will drop. Therefore it is necessary to set the cell voltage higher than the saturation point $V_{CB}$ so that the action is stable.

Figure 4:
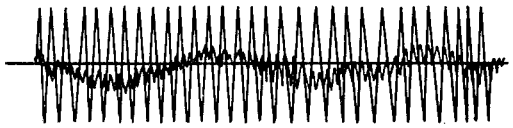
FIG. 4 is a schematic diagram of the fundamental wave-form of the noise output obtained when an inverse voltage higher than the breakdown point is impressed on the Zener diode shown in FIG. 2.
Figure 5:
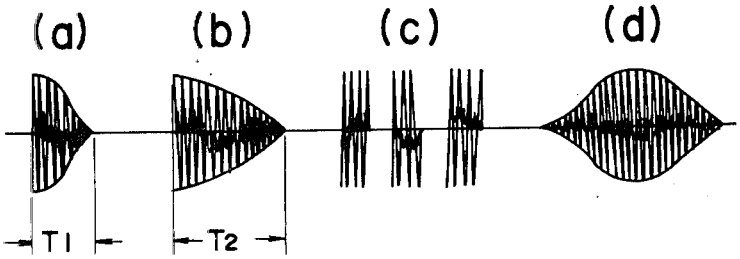
FIG. 5 illustrates the noise output characteristics obtained in various embodiments of the present invention, (a) being a schematic wave-form of a pistol shot sound, (b) that of a rifle shot sound, (c) that of a train steam exhaust sound, and (d) that of a surging wave sound.

The fundamental wave is yielded by applying an inverse voltage higher than the breakdown point to the semiconductor (in this case a Zener diode). The fundamental wave thus yielded will look like FIG. 4. Sound effects will be produced by cutting the fundamental wave yielded thus in random fashion to an appropriate length. FIG. 5 illustrates examples, (a) being a piston shot sound, (b) a rifle shot sound, (c) a train steam exhaust sound, and (d) a surging wave sound.

The piston shot sound and the rifle shot sound are characterized such that at the instant of the trigger being pulled, a heavy sound is issued and at the next instant, i.e., $T_1$, $T_2$, it attenuates (the rifle shot takes a little longer time to attenuate). The train exhaust sound is characteristically intermittent. The surging wave sound has such a characteristic that it gradually intensifies from a specific time point and gradually attenuates from a peak value.

Figure 6:
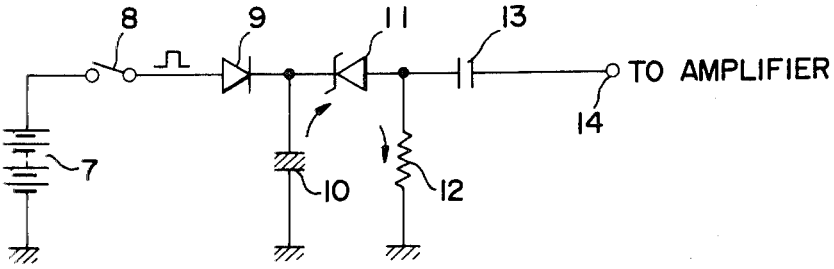
FIG. 6 shows the principal electric circuit which is capable of reproducing a pistol shot sound, a rifle shot sound or a water splash sound in the device illustrated in FIG. 1.

Next, referring to FIG. 6, an example of the circuit in FIG. 1 is illustrated. This is a circuit producing the sound effects of a piston shot, a rifle shot and a water flow, 7 being the cell as the power source of the fundamental wave-generating circuit 1, 8 being the on-off switch which instantaneously closes in response to the pistol or rifle trigger being pulled, 9 being a diode which constitutes the gate circuit 5, 10 being a condenser, 11 being a Zener diode, 12 being a resistor, 13 being a bypass condenser, and 14 being the output terminal, which is connected to the input side of the amplifying circuit 2 shown in FIG. 1. The condenser 10 and the resistor 12 constitute the attenuator 4, while the switch 8 constitutes the on-off control circuit 6. The attenuator 4 is not always necessary. Meanwhile an increased resistance of the resistor 12 is equivalent to non-presence of the attenuator 4 with the same action.

In the illustrated circuit, when the trigger is pulled, the switch 8 closes thereby causing current to flow from the cell 7 into the diode 9 and a voltage is impressed on the Zener diode 11. If the voltage of the cell 7 is set higher than the breakdown voltage of the Zener diode 11, the Zener diode 11 will generate the random noise (fundamental wave). This noise passes through the condenser 13 and goes from the output terminal 14 into the amplifying circuit 2 where it is amplified and issues from the speaker 3.

Figure 7:
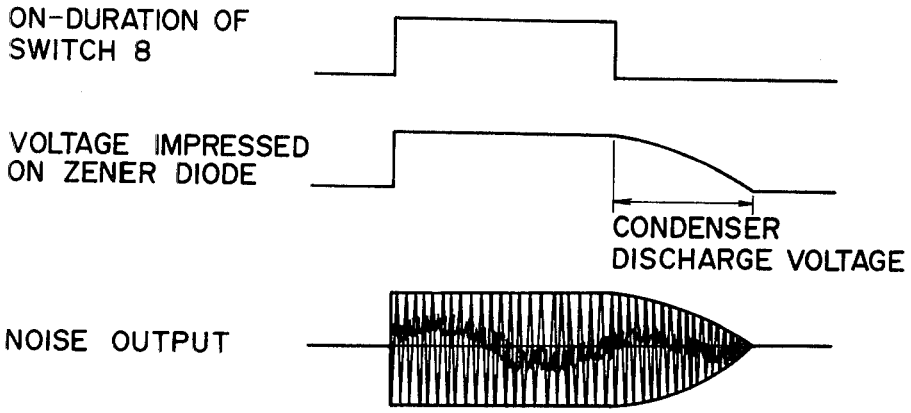
FIG. 7 is a schematic diagram illustrating one example of the actions of the circuit shown in FIG. 6.

The current flowing in the diode 9 is thus impressed on the Zener diode 11, while at the same time it flows into the condenser 10, too, thereby instantaneously charging it. Therefore if the switch 8 closes and at next instant opens, as indicated in FIG. 7, the charge stored in this condenser 10 causes a voltage to be impressed on the Zener diode 11. Then a discharge takes place from the Zener diode 11 through the resistor 12 whereby the voltage impressed on the Zener diode 11 will steadily attenuate. In consequence, as desired above, the noise output also drops steadily, yielding a noise output characterized by attenuation.

In this circuit the attenuation time can be varied by changing the values in the condenser 10 and the resistor 12, thereby distinguishing the sound effects between pistol and rifle.

Figure 8:
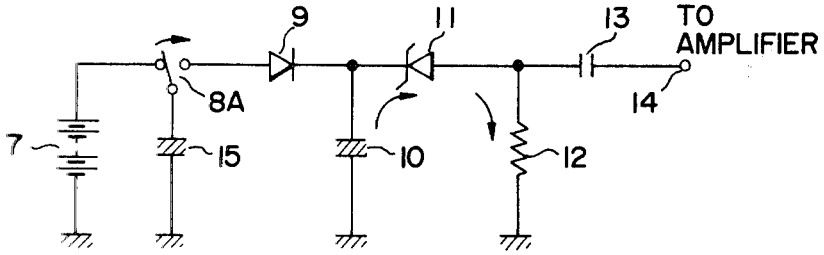
FIG. 8 shows the principal electric circuit of a surging wave sound producer as one embodiment of the present invention.

FIG. 8 illustrates another embodiment of the present invention, i.e., a wave sound producer such as shown in FIG. 5(*d*), for example. Like symbols denote like elements. In this example, an outer step-up attenuation circuit comprises the switch 8A, the condensers 15, 10, the gate circuit 9 and the resistor 12. The switch 8A is changed from the side of the cell 7 to the side of the diode 9 and a condenser 15 is between the switch 8A and the earth.

In this circuit, when the switch 8A is swiftly changed from the cell 7 side terminal to the diode 9 side terminal, the terminal voltage of the condenser 15 will be stepped up and correspondingly the voltage impressed from the condenser 15 through the diode 9 on the Zener diode 11 will also be stepped up. In consequence the noise output from the Zener diode 11 will be stepped up.

Thereafter, when the switch 8A is set to the neutral position, the voltage stored in the condenser 10 is decreased through the resistor 12, thereby yielding the same attenuation characteristic as in the preceding example. As a result, a wave surging effect as illustrated in FIG. 5(*d*) emerges. If in this circuit a resistor is connected between the switch 8A and the cell 7, the voltage rise in the condenser 15 will become mild and accordingly it is possible to make the noise output rise slowly by a relatively slow operation of the switch.

Figure 9:
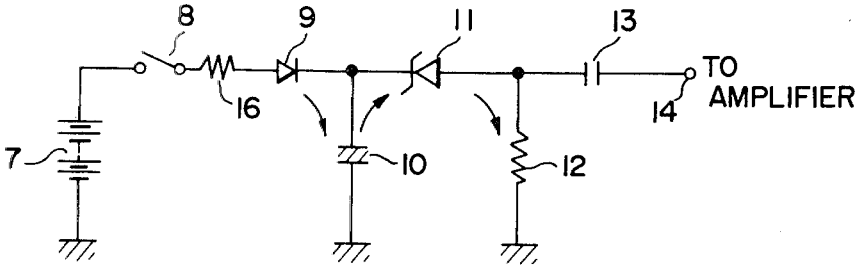
FIG. 9 shows a variation of the circuit illustrated in FIG. 8.

FIG. 9 shows a variation of the circuit in FIG. 8. Like symbols denote like elements. In this example, a resistance 16 is connected in series with the switch 8 between the cell 7 and the diode 9 in the circuit of FIG. 6. When the switch 8 is held on for a specific duration, the noise output slowly rises.

Next, when the switch 8 is set off, the noise output will slowly drop, yielding a wave surging effect as illustrated in FIG. 5(*d*).

In generation of a pistol shot sound and a rifle shot sound, the rise part and the plus potential-imposed part in the noise output of the Zener diode decrease the fidelity of the sound effects. For this reason, if the pistol sound or the rifle sound is to be of high fidelity, it is desirable to ground the output signal when the on-off control circuit is on, and take out only the output for the attenuated period of the noise output of the Zener diode 11, i.e., for the condenser discharge period. A device meeting such a requirement is illustrated in FIGS. 10 and 11.

Figure 10:
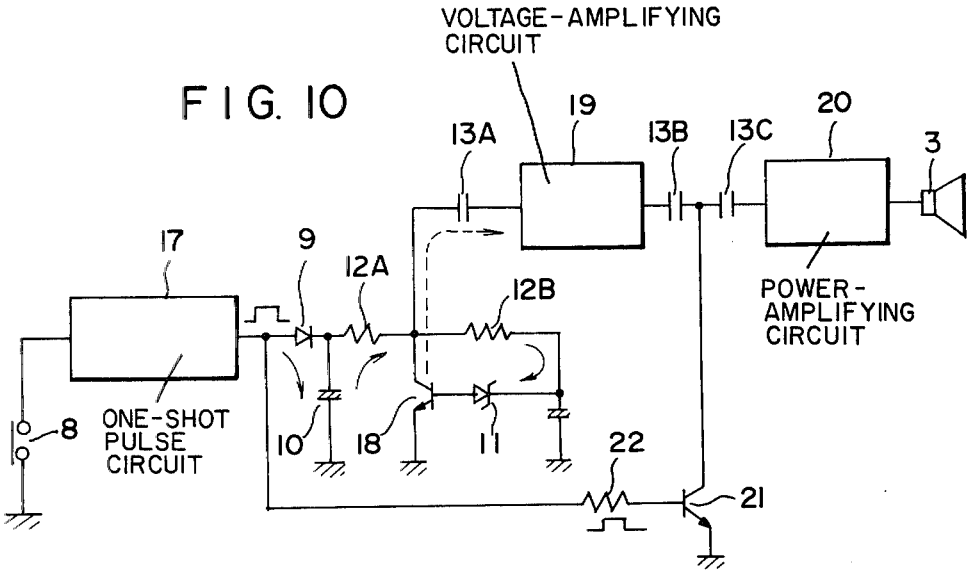
FIG. 10 shows a variation of the circuit illustrated in FIG. 6.
Figure 11:
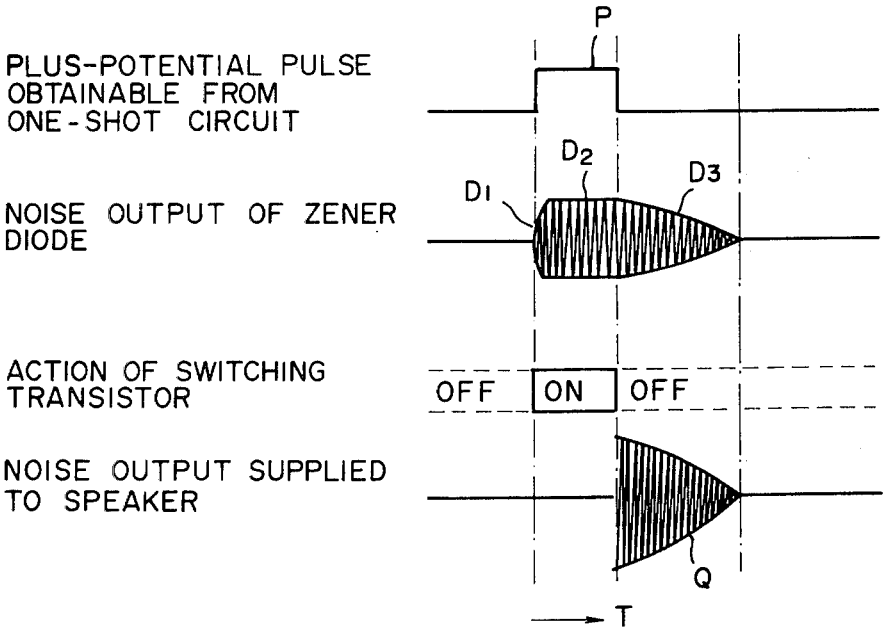
FIG. 11 is a schematic diagram illustrating action of the circuit shown in FIG. 10.

In FIG. 10, 8 is a switch; 17 is a one-shot pulse circuit, both of them constituting a part of the control circuit; 9 is a diode which constitutes the gate circuit; 10 is a condenser; and 12A, 12B are resistors. The condenser 10 and the resistors 12A, 12B constitute part of the attenuator. Zener diode 11 constitutes the fundamental wave-generating circuit; 13A, 13B, 13C are bypass condensers; 18 is an amplifying transistor; 19 is a voltage-amplifying circuit; and 20 is a power-amplifying circuit. Both circuits 19, 20 constitute the amplifying circuit 2, and 3 is a speaker.

The base of the switching transistor 21 is connected via the resistor 22 between the pulse-generating circuit 17 and the diode 9. The collector of the diode is connected between the condensers 13B, 13C, and the emitter is grounded. In FIG. 10, the power source is not shown.

Figure 12:
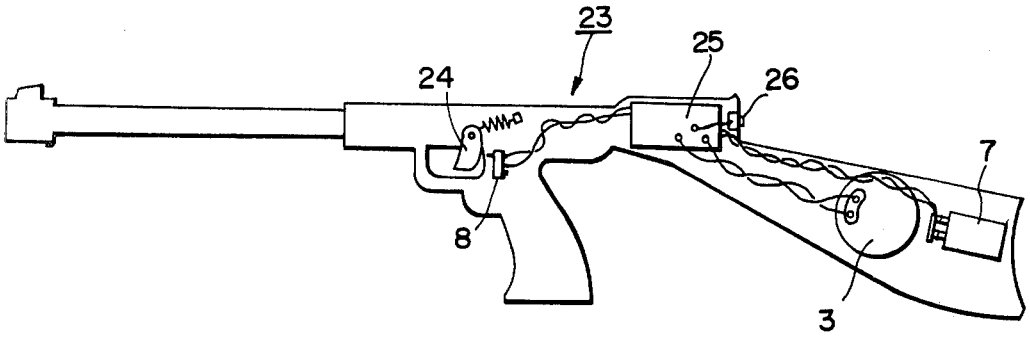
FIG. 12 is a schematic diagram showing a toy rifle having a built-in circuit of the type shown in FIG. 10.

The circuit shown in FIG. 10 is built into the rifle 23, as illustrated in FIG. 12. In FIG. 12, 24 is a trigger, and when this trigger is pulled, the switch 8 will be on. Numeral 7 identifies a cell; 3 is a speaker; 25 is a print base, into which the fundamental wave-generating circuit 1, the amplifying circuit 2, the attenuation circuit 4, the gate circuit 5, the pulse circuit 17 and the switching transistor 21 are built; and 26 is a power switch.

In the device illustrated in FIGS. 10 and 12, when the trigger 24 is pulled, the switch 8 will be on. A plus-potential pulse is then generated for a specific period from the pulse circuit 17. In FIG. 11, P denotes the pulse waveform. Generally, this plus-potential pulse signal is set shorter than the switch on time obtained when the trigger 24 is manually pulled. Upon this pulse signal, the condenser 10 is immediately charged and at the same time the pulse signal is sent to the cathode side of the Zener diode 11 through the gate diode 9, and the resistances 12A, 12B whereby a noise is produced from the Zener diode 11. In FIG. 11, $D_1$ indicates the rise part of the noise output signal, while $D_2$ indicates the region of stable output.

Next, when the pulse signal ceases to be given, the noise output of the Zener diode 11 gradually attenuates with discharge of the condenser 10. The attenuation region is indicated by $D_3$ in FIG. 11.

Meanwhile the plus-potential pulse coming out of the pulse circuit 17 goes through the resistor 22 and is supplied also to the base of the switching transistor 21. When there is no potential impressed on its base, this transistor 21 is off and a high resistance is maintained between the voltage-amplifying circuit 19 and the ground. When a plus-potential pulse is applied to the base of the transistor 21, the transistor 21 is in the state of continuity while the pulse is in presence and the noise output of the Zener diode 11 is grounded. Thus only the attenuated wave part $D_3$ of the noise output is given to the power-amplifying circuit 20 and this will be amplified as Q in FIG. 11 whereby only an attenuated sound issues from the speaker 3.

If the switch is partially modified to a counter circuit or a timer circuit or modified such that the contact is mechanically made and broken repeatedly, a train exhaust sound or a machine gun sound will be reproduced.

Figure 13:
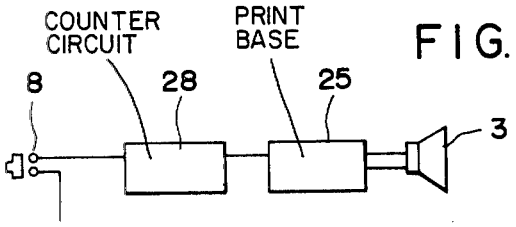
FIG. 13 is a schematic diagram of a machine gun shot sound producer as one embodiment of the present invention.

FIG. 13 is a case of the switch 8 being connected to a counter circuit 28, otherwise the construction is the same as in the preceding example.

Figure 14:
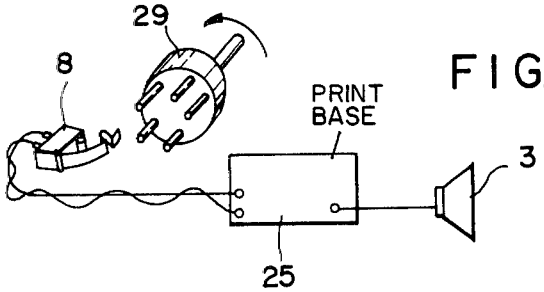
FIG. 14 shows a variation of the machine gun shot sound producer shown in FIG. 13.

FIG. 14 is a case of the switch 8 being mechanically closed and opened in repetition by the action of the rotor 29 as a switching member, otherwise the construction is the same as in the preceding example.

Figure 15:
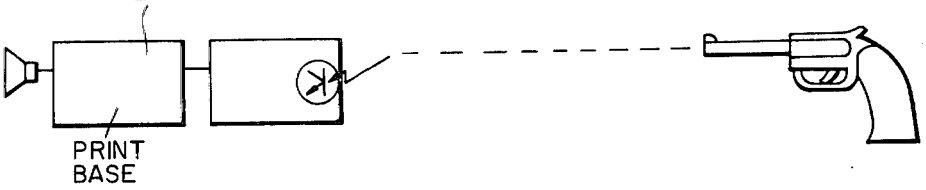
FIG. 15 is a block diagram of an electric circuit built into a beam gun target device according to the present invention.

FIG. 15 is a case of a device according to the present invention being built into a beam gun target, the construction being the same as in the preceding example except the switch 8 is a photosensitive one.

The present invention produces various sound effects with great ease. It comprises a simplified circuit and may therefore be built into a small toy and the like.

What is claimed:

1. A sound effects producer comprising a Zener diode semiconductor element, an inverse voltage impressing means for impressing to the Zener diode semiconductor element inverse voltage sufficient to generate output having a random noise component, as an alternating current component from an output side of the semiconductor element, an amplification circuit connected to the output side of the Zener diode semiconductor element for amplifying the output, a speaker connected to the output side of the amplification circuit for converting output amplified by the amplification circuit to audible sound, and a control circuit for controlling the output wave-form of the inverse voltage impressing means, the control circuit comprising an on-off control circuit connected between the Zener diode semiconductor element and the power source of the inverse voltage impressing means, an attenuator for causing attenuation of the output signal from the Zener diode semiconductor element, and a switching circuit to ground the output signal from the Zener diode semiconductor element while the on-off control circuit is in the on position.

2. A sound effects producer as in claim 1 wherein the switching circuit comprises a gate circuit connected between the attenuator and the on-off control circuit, and a switching transistor, the base side of which is connected between the gate circuit and the on-off control circuit, the collector side of which is connected to the output terminal side of the Zener diode semiconductor element, and the emitter side of which is grounded.

* * * * *